US010770251B2

(12) United States Patent
Xu et al.

(10) Patent No.: US 10,770,251 B2
(45) Date of Patent: Sep. 8, 2020

(54) ALTERNATING CURRENT CONTACTOR

(71) Applicant: ZHEJIANG CHINT ELECTRICS CO., LTD., Zhejiang (CN)

(72) Inventors: Ping Xu, Zhejiang (CN); Yujia Hu, Zhejiang (CN); Xingdong Zhang, Zhejiang (CN); Zhiwen Zhang, Zhejiang (CN); Tifeng Xiao, Zhejiang (CN)

(73) Assignee: ZHEJIANG CHINT ELECTRICS CO., LTD. (CN)

( * ) Notice: Subject to any disclaimer, the term of this patent is extended or adjusted under 35 U.S.C. 154(b) by 94 days.

(21) Appl. No.: 15/781,160

(22) PCT Filed: Oct. 24, 2016

(86) PCT No.: PCT/CN2016/103049
§ 371 (c)(1),
(2) Date: Jun. 4, 2018

(87) PCT Pub. No.: WO2017/097044
PCT Pub. Date: Jun. 15, 2017

(65) Prior Publication Data

US 2018/0350543 A1 Dec. 6, 2018

(30) Foreign Application Priority Data

Dec. 9, 2015 (CN) ..... 2015 2 1013928 U

(51) Int. Cl.
*H01H 50/30* (2006.01)
*H01H 50/36* (2006.01)
(Continued)

(52) U.S. Cl.
CPC ..... *H01H 50/36* (2013.01); *H01H 50/04* (2013.01); *H01H 50/14* (2013.01); *H01H 50/44* (2013.01);
(Continued)

(58) Field of Classification Search
CPC ..... H01H 50/04; H01H 50/045; H01H 50/30–50/305
See application file for complete search history.

(56) References Cited

U.S. PATENT DOCUMENTS 2,671,187 A * 3/1954 Jencks ..... H01F 7/1623 335/257
3,813,621 A 5/1974 Blum ..... 335/99
6,037,852 A 3/2000 Pfab

FOREIGN PATENT DOCUMENTS

CN 201741638 U 2/2011
CN 203850215 U 9/2014
(Continued)

OTHER PUBLICATIONS

International Search Report dated Dec. 28, 2016 in corresponding PCT International Application No. PCT/CN2016/103049.
(Continued)

*Primary Examiner* — Ramon M Barrera
(74) *Attorney, Agent, or Firm* — Ostrolenk Faber LLP

(57) ABSTRACT

An alternating current contactor comprises a base and a magnetic yoke. The magnetic yoke is mounted on a bottom plate of the base. A magnetic yoke support for supporting and buffering the magnetic yoke is respectively provided at two sides of the magnetic yoke, wherein sidewalls at two sides of each magnetic yoke support, which are connected with the magnetic yoke are different in thickness. The magnetic yoke support of the alternating current contactor of the utility model has a simple structure due to the arrangement of an asymmetric eccentric structure. The up-down position of the magnetic yoke relative to the bottom plate of the base can be adjusted by changing an assembly direction of the magnetic yoke supports, thereby achieving the purpose of adjusting the total stroke of the product with high flexibility. When a dimension of a housing of a plastic part
(Continued)

is abnormal, the magnetic yoke has a certain adjustment amount to ensure that the integral assembly of the product can be completed and the efficiency and reliability can be improved.

10 Claims, 5 Drawing Sheets

(51) Int. Cl.

| | |
|---|---|
| ***H01H 50/04*** | (2006.01) |
| ***H01H 50/14*** | (2006.01) |
| ***H01H 50/44*** | (2006.01) |
| ***H01H 50/54*** | (2006.01) |
| *H01H 50/16* | (2006.01) |

(52) U.S. Cl.
CPC ..... *H01H 50/54* (2013.01); *H01H 50/163* (2013.01); *H01H 2050/446* (2013.01)

(56) References Cited

FOREIGN PATENT DOCUMENTS

| | | |
|---|---|---|
| CN | 205335181 U | 6/2016 |
| CN | 205376416 U | 7/2016 |
| DE | 2 333 165 A1 | 4/1974 |
| DE | 195 46 763 | 6/1997 |
| EP | 1 271 593 | 1/2003 |
| WO | WO 97/14165 | 4/1997 |

OTHER PUBLICATIONS

Written Opinion dated Dec. 28 2016 in corresponding PCT International Application No. PCT/CN2016/103049.
Supplementary European Search Report dated Jun. 12, 2019 issued in European Patent Application No. 16872238.7.

* cited by examiner

ALTERNATING CURRENT CONTACTOR

CROSS-REFERENCE TO RELATED APPLICATIONS

The present application is a 35 U.S.C. §§ 371 national phase conversion of PCT/CN2016/103049, filed Oct. 24, 2016, which claims priority to Chinese Patent Application No. 201521013928.X, filed Dec. 9, 2015, the contents of which are incorporated herein by reference. The PCT International Application was published in the Chinese language.

TECHNICAL FIELD

The utility model relates to the technical field of low voltage apparatuses, and in particular, to an alternating current contactor.

BACKGROUND ART

There is no protection measure generally for a coil of an existing alternating current contactor under normal circumstances. But under special environments, the coil can be protected with the assistance of a surge suppressor. However, the surge suppressor needs to be connected with the coil, and in order to approach to the coil, it is necessary to provide a mounting groove or a concave hole near the coil to place the surge suppressor. The surge suppressor is mounted inside a product and occupies a large area, which makes the design of a base more complicated, and increases the design difficulty and the machining difficulty of a mold and results in low production efficiency. In addition, it is necessary to mount the surge suppressor inside the product during assembling, so the process is more complicated and not inconvenient for assembly.

Moreover, with respect to the existing contactor, it is often to cause the failure of integral assembly of the product due to machining errors, this is mainly because of the lack of an adjusting structure for adjusting a total stroke of the product, thereby bringing great convenience for production. For example, contact surfaces of a coil frame of the existing contactor close to the base are all planes, so as to avoid interference with the base structure, and the mold manufacturing process is relatively simple and convenient for measurement. However, the amount of compression of supports is limited by the entire planes, so it is not possible to adjust the total stroke of the product through the dimension of the coil frame. Moreover, the supports are adopted to fix a magnetic yoke in the existing contactor to play a certain buffering role. Each support generally uses a symmetric non-eccentric structure. Although the mold manufacturing process is simple, it is not possible to adjust parameters by forward or inverse assembly if the parameters, such as the total stroke of the contactor are not consistent, so the flexibility is poor. Plastic parts, owing to changes in material, process, deformation, etc., easily lead to non-compliance of dimensions, resulting in changes in the dimension of the total stroke, which will cause the total stroke to be too large or too small, thus affecting the overtravel of the product and affecting the reliability of the product.

SUMMARY OF THE UTILITY MODEL

An objective of the utility model is to overcome the defects of the prior art and provides an alternating current contactor which is simple in structure and high in reliability.

To fulfill the said objective, the utility model adopts the following technical solution.

An alternating current contactor comprises a base 1 and a magnetic yoke 4, wherein the magnetic yoke 4 is mounted on a bottom plate of the base 1, and a magnetic yoke support 41 for supporting and buffering the magnetic yoke 4 is respectively provided at two sides of the magnetic yoke 4, wherein sidewalls at two sides of each magnetic yoke support 41, which are connected with the magnetic yoke 4 are different in thickness.

Preferably, each magnetic yoke support 41 is provided with identifying members 411 used for distinguishing the sidewalls at two sides, which are different in thickness.

Preferably, each identifying member 411 is a bulge or a groove.

Preferably, each identifying member 411 is circular.

Preferably, a ratio of the thicknesses of the sidewalls at two sides of each magnetic yoke support 41, which are different in thickness, is 4:3.

Preferably, a mounting groove 412 is provided at a junction between each magnetic yoke support 41 and the magnetic yoke 4, and sidewalls at two sides of the mounting groove 412 are different in thickness.

Preferably, the bottom of the magnetic yoke 4 is provided with a magnetic yoke through hole 42 that is penetrated horizontally, a magnetic yoke mounting sheet 43 penetrates through the magnetic yoke through hole 42, and two ends of the magnetic yoke mounting sheet 43 which are exposed out of the magnetic yoke 4 are wrapped and fixed with the magnetic yoke supports 41 for supporting and buffering the magnetic yoke 4.

Preferably, the magnetic yoke 4 is fixedly connected with the base 1 through the magnetic yoke supports 41 at two sides of the magnetic yoke 4, two horizontally inverted concave platforms 13 are oppositely provided between two sidewalls in the base 1, and recessed sidewalls of each concave platform 13 are respectively provided with a fixing groove 131 for fixing the corresponding magnetic yoke support 41; a mounting groove 412 which cooperates with the corresponding magnetic yoke mounting sheet 43 is formed in one end of the square bey block magnetic yoke support 41, and a fixing bump 413 which cooperates with the fixing groove 131 and in the shape of a triangular prism is provided at the other end of the magnetic yoke support 41; a magnetic yoke mounting groove 14 in which the magnetic yoke 4 and a part of the magnetic yoke mounting sheet 43, which is wrapped with the magnetic yoke support 41 are mounted, is formed between the concave platform 13 and the base 1; during mounting, the magnetic yoke 4 is mounted into the magnetic yoke mounting groove 14, and the part of each magnetic yoke mounting sheet 43, which is wrapped with the magnetic yoke support 41, is clamped into the recessed part of each of the two concave platforms 13, and meanwhile, each fixing bump 413 is clamped into the corresponding fixing groove 131 to fix the magnetic yoke 4.

Preferably, a buffering cushion 7 for buffering the magnetic yoke 4 is provided between the base 1 and the magnetic yoke 4.

Preferably, a coil frame 3 mounted on the magnetic yoke 4 is provided inside the base 1 and comprises an upper connecting plate 33, a lower connecting plate 31 and a wiring post 32 provided between the upper connecting plate 33 and the lower connecting plate 31; an annular groove in which a coil 5 is placed is formed among the upper connecting plate 33, the lower connecting plate 31 and the wiring post 32; the wiring post 32 is axially provided with a frame through hole 34, and the coil frame 3 is fixed on the magnetic yoke 4 through the frame through hole 34 in the wiring post; the magnetic yoke 4 is of an E-type structure, and the E-type magnetic yoke 4 is mounted on the bottom plate of the base 1, with an opening facing upwards; the coil frame 3 slides to an adjusting bulge 311 of the coil frame 3 along the middle part of the E-type magnetic yoke and props against the magnetic yoke supports 41 of the magnetic yoke 4; a wiring terminal 6 which is connected with the coil 5 is mounted on a sidewall of the base 1, the outer wall at one side of the base 1, which is close to the wiring terminal 6, is provided with two surge mounting holes 11 which are used for fixing a surge suppressor 2 and distributed linearly; the outer wall of the surge suppressor 2, which contacts the base 1, is correspondingly provided with two mounting bumps 21 which cooperate with the surge mounting holes 11, and a sidewall of each mounting bump 21 protrudes to form a hook 211 which is in interference fit with the corresponding surge mounting hole 11; the surge suppressor 2 is plugged into the surge mounting holes 11 of the base 1 through the mounting bumps 21 on the surge suppressor 2 to be fixedly connected with the base 1; after assembling, the surge suppressor 2 is adjacent to the wiring terminal 6 to facilitate a wiring connection therebetween.

The magnetic yoke support of the alternating current contactor of the utility model has a simple structure due to the arrangement of an asymmetric eccentric structure. The up-down position of the magnetic yoke relative to the bottom plate of the base can be adjusted by changing an assembly direction of the magnetic yoke supports, thereby achieving the purpose of adjusting the total stroke of the product with high flexibility. When a dimension of a housing of a plastic part is abnormal, the magnetic yoke has a certain adjustment amount to ensure that the integral assembly of the product can be completed and the efficiency and reliability can be improved. Therefore, it is convenient to guarantee that the up-down positions of a thick wall and a thin wall of the magnetic yoke support at each of two sides of the magnetic yoke are consistent during assembling, and it is also convenient to distinguish and adjust at the time of adjustment, such that the efficiency and the reliability are improved. Further, the assembly structure of the coil frame, the magnetic yoke and the base is simple, reliable and efficient.

DETAILED DESCRIPTION OF THE PREFERRED EMBODIMENTS

The specific embodiments of an alternating current contactor of the utility model are further described below with reference to the embodiments shown in FIGS. 1 to 9. The alternating current contactor of the utility model is not limited to the description of the following embodiments.

Figure 1:
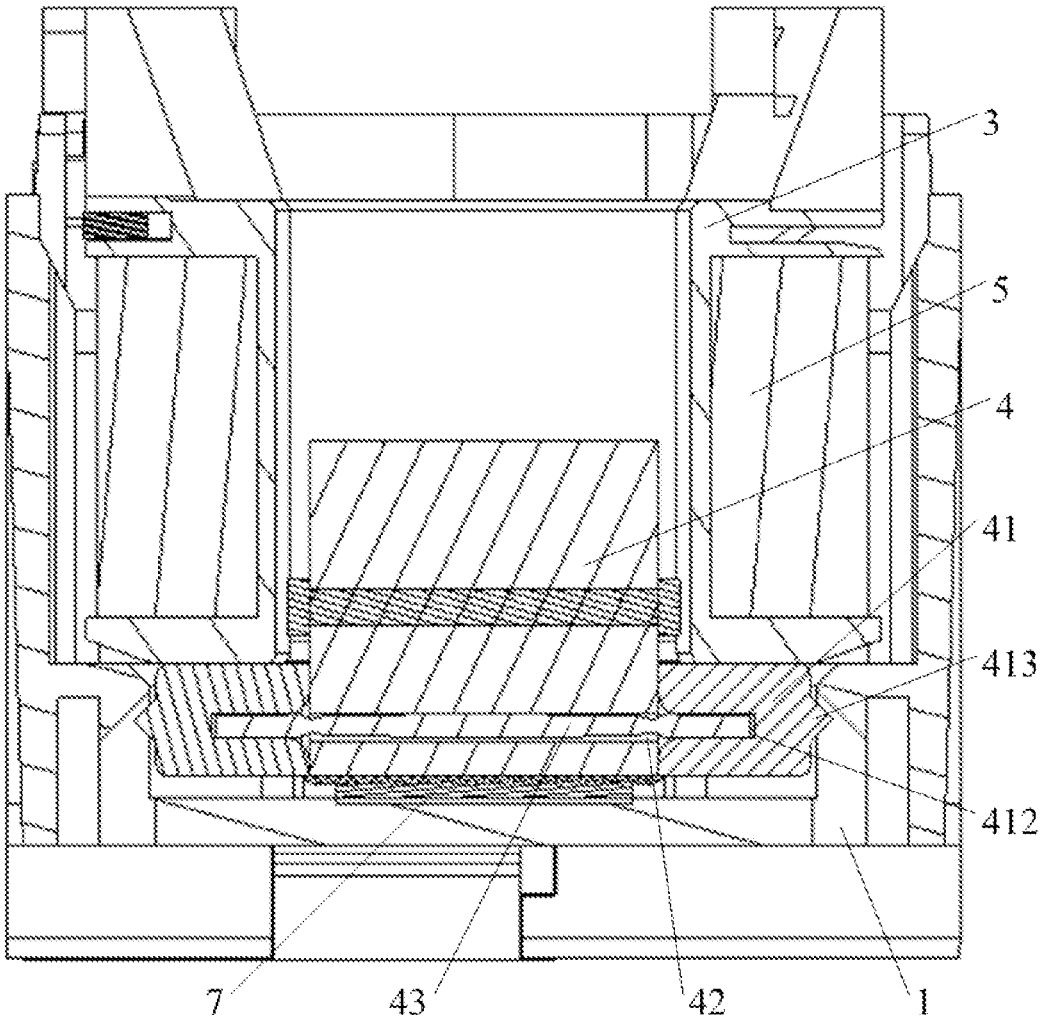
FIG. 1 is a sectional view of an internal structure of a base of an alternating current contactor of the utility model.
Figure 2:
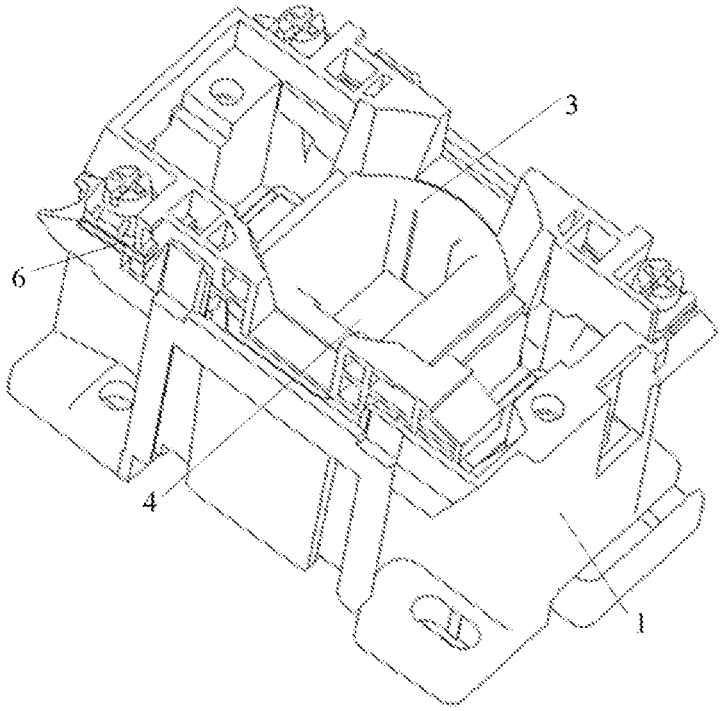
FIG. 2 is an assembly stereogram of the internal structure of the base of the alternating current contactor of the utility model.
Figure 3:
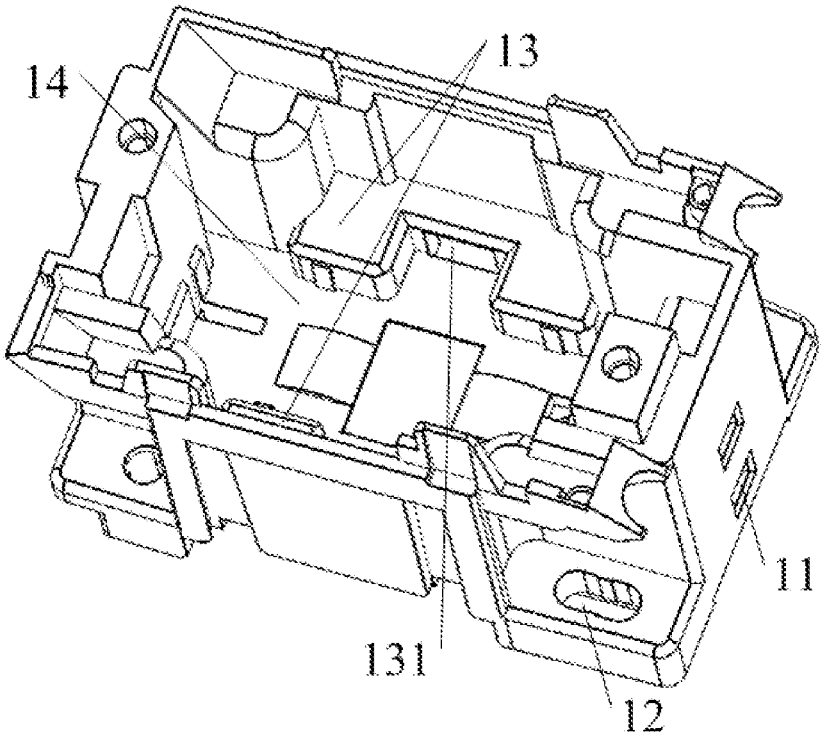
FIG. 3 is a schematic structural diagram of the base of the utility model.

As shown in FIGS. 1 to 3, the alternating current contactor of the utility model comprises a base 1, a surge suppressor 2, a magnetic yoke 4, a coil frame 3, a coil 5, a wiring terminal 6 and a buffering cushion 7. The magnetic yoke 4 is mounted on a bottom plate of the base 1. The buffering cushion 7 for buffering the magnetic yoke 4 is provided between the magnetic yoke 4 and the bottom plate of the base 1. The coil frame 3 is mounted on the magnetic yoke 4 and sunken into the base 1. The coil 5 sleeves the coil frame 3 and is positioned between the coil frame 3 and the magnetic yoke 4. The wiring terminal 6 is mounted on the coil frame 3 and fixed to the upper end of a sidewall of the base 1 together with the coil frame 3. The wiring terminal 6 is electrically connected with the coil 5. The surge suppressor 2 is mounted on an outer wall at one side of the base 1 close to the wiring terminal 6 to facilitate a wiring connection with the wiring terminal 6.

Figure 6:
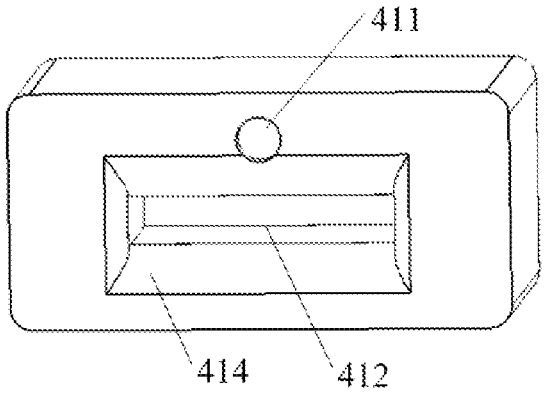
FIG. 6 is a schematic structural diagram of a magnetic yoke support of the utility model.

FIGS. 1 to 3 illustrate an assembly structure of the base 1 and the magnetic yoke 4 of the utility model. Mounting screw holes 12 for mounting and fixing the contactor in a use position are formed in four outer corners of the base 1. The magnetic yoke 4 is fixedly connected with the base 1 through magnetic yoke supports 41 at two sides of the magnetic yoke 4. Two horizontally inverted concave platforms 13 are oppositely provided between two sidewalls in the base 1, and a recessed sidewall of each concave platform 13 is provided with a fixing groove 131 for fixing the corresponding magnetic yoke support 41. The bottom of the magnetic yoke 4 is provided with a magnetic yoke through hole 42 that is penetrated horizontally, a magnetic yoke mounting sheet 43 penetrates through the magnetic yoke through hole 42, and two ends of the magnetic yoke mounting sheet 43 that are exposed out of the magnetic yoke 4 are wrapped and fixed with the square block shaped magnetic yoke supports 41 for fixing and buffering the magnetic yoke 4. Referring to FIG. 6, a mounting groove 412 which cooperates with the corresponding magnetic yoke mounting sheet 43 is formed in one end of each square block shaped magnetic yoke support 41, and a fixing bump 413 which cooperates with the fixing groove 131 and is in the shape of a triangular prism is provided at the other end of the magnetic yoke support 41. Circular arc chamfers 414 are provided around a port of the mounting groove 412, such that the magnetic yoke support 41 is mounted in place. A magnetic yoke mounting groove 14 which is used for mounting the magnetic yoke 4 and a part of the magnetic yoke mounting sheet 43, which is wrapped with the magnetic yoke support 41, is formed between each concave platform 13 and the base 1. During mounting, the magnetic yoke 4 is mounted into the magnetic yoke mounting groove 14, and the part of each magnetic yoke mounting sheet 43, which is wrapped with the magnetic yoke support 41 is clamped into the recessed part of each of the two concave platforms 13, and meanwhile, the fixing bumps 413 are clamped into the fixing grooves 131 to fix the magnetic yoke 4.

Figure 4:
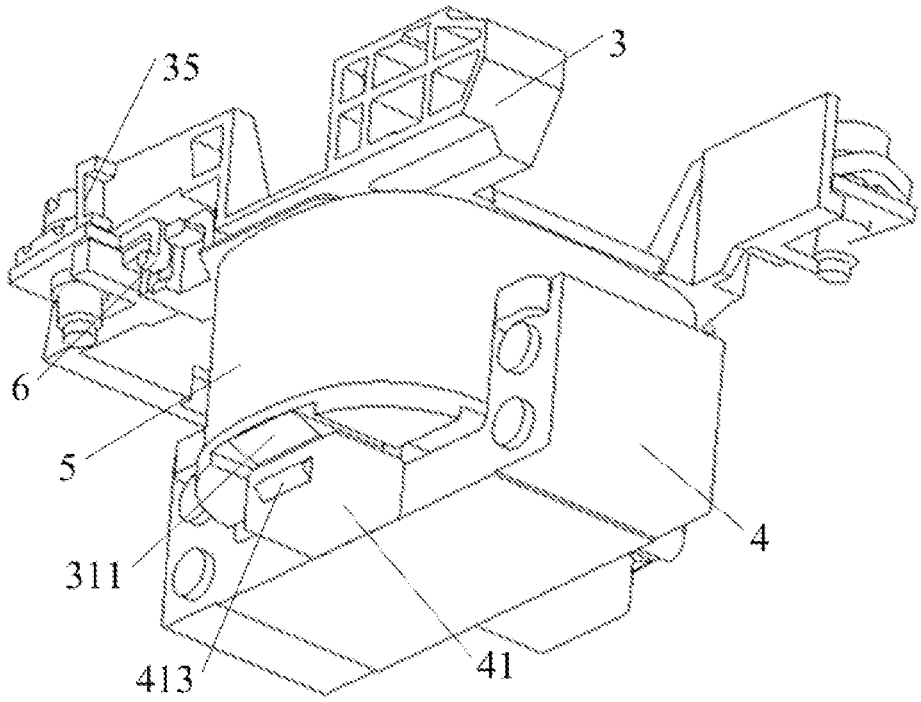
FIG. 4 is an assembly view of a magnetic yoke, the coil frame, a coil and a wiring terminal of the utility model.
Figure 5:
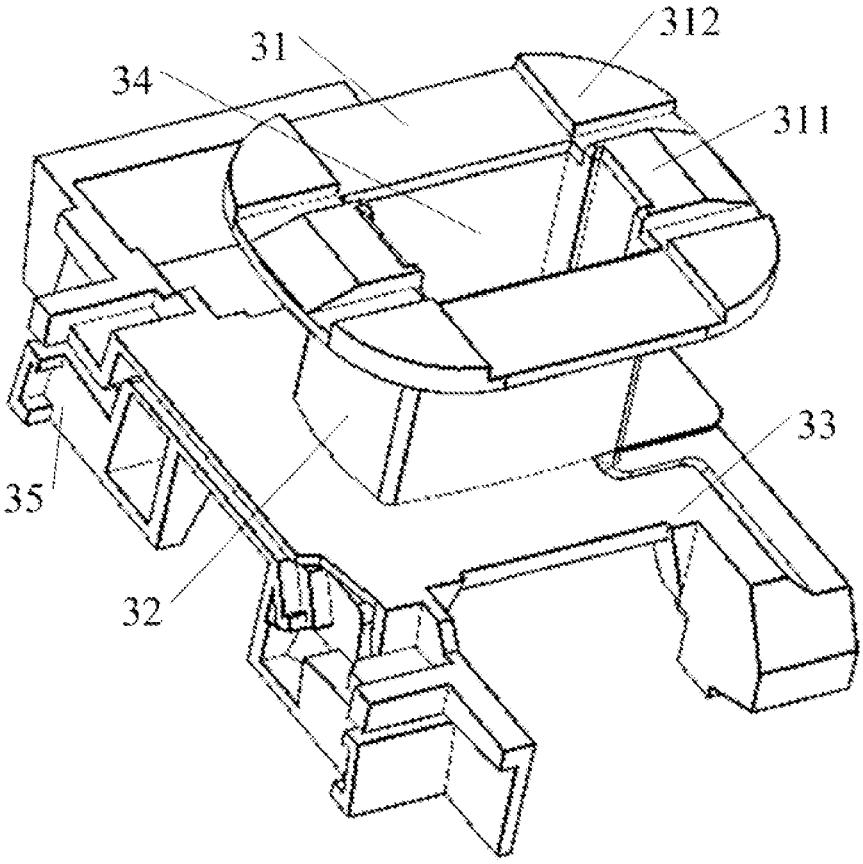
FIG. 5 is an inverted view of the coil frame of the utility model.

As shown in FIG. 4 and FIG. 5, the coil frame 3 of the utility model comprises an upper connecting plate 33, a lower connecting plate 31 and a wiring post 32 provided between the upper connecting plate 33 and the lower connecting plate 31. An annular groove in which the coil 5 is placed is formed among the upper connecting plate 33, the lower connecting plate 31 and the wiring post 32. The wiring post 32 is axially provided with a frame through hole 34, and the coil frame 3 is fixedly mounted on the magnetic yoke 4 through the frame through hole 34 formed in the wiring post 32. The magnetic yoke 4 is of an E-type structure, and the E-type magnetic yoke 4 is mounted on the bottom plate of the base 1, with an opening facing upwards. The coil frame 3 slides to an adjusting bulge 311 of the coil frame 3 along the middle part of the E-type magnetic yoke and props against the magnetic yoke supports 41 of the magnetic yoke 4. Connecting bosses 35 are provided at four corners of the upper connecting plate 33 of the coil frame 3 and fixedly clamped onto the corners at the upper end of the base 1. At least one of the four connecting bosses 35 is used for mounting and fixing the wiring post 6, wherein at least one connecting boss on which the wiring terminal 6 is mounted is adjacent to a surge suppressor mounted on the outer wall of the base 1. The coil 5 sleeves the wiring post 32 of the coil frame 3 and is located in two openings of the E-type magnetic yoke 4. The coil 5 mounted on the coil frame 3 is electrically connected with the wiring terminal 6 in a wiring connection manner.

Figure 7:
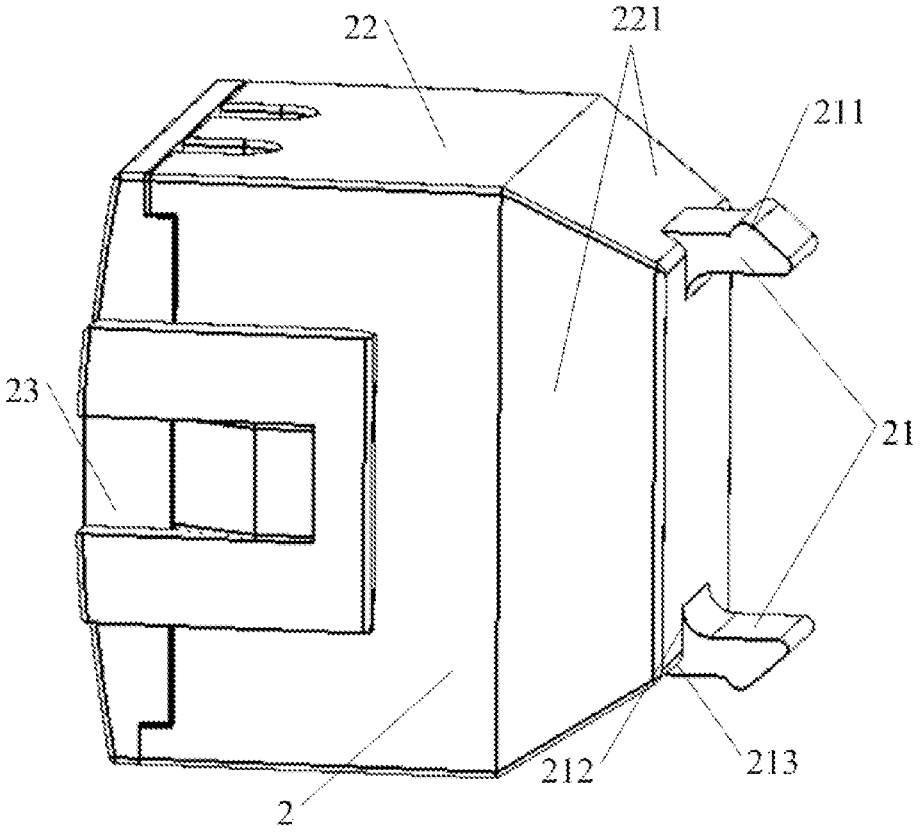
FIG. 7 is a schematic structural diagram of a surge suppressor of the utility model.

FIG. 3 and FIG. 7 illustrate a mounting structure for the base and the surge suppressor of the alternating current contactor of the utility model. The alternating current contactor comprises the base 1 and the surge suppressor 2. The wiring terminal 6 which is connected with the coil 5 is mounted on the corner of the upper end of a sidewall of the base 1. The outer wall at one side of the base 1, which is close to the wiring terminal 6 is provided with surge mounting holes 11 which are used for fixing the surge suppressor 2. The outer wall of the surge suppressor 2, which contacts the base 1, is correspondingly provided with mounting bumps 21 which cooperate with the surge mounting holes 11. The surge suppressor 2 is plugged into the surge mounting holes 11 of the base 1 through the mounting bumps 21 on the surge suppressor 2 to be fixedly connected with the base 1. After assembling, the surge suppressor 2 is adjacent to the wiring terminal 6 to facilitate a wiring connection therebetween. Since the surge suppressor is buckled and connected to the outer wall of the base and is adjacent to the wiring terminal, the structure is simple, the reliability in positioning and mounting is ensured, the assembly procedures are simplified to facilitate user's operations, heat can be dissipated conveniently, and the assembly efficiency and the product reliability are improved. Meanwhile, a mold structure of the base is simplified to facilitate manufacturing and production. The production efficiency of spare parts is greatly improved due to the adoption of a form of one out of two or one out of four. The layout is reasonable to facilitate the wiring connection between the surge suppressor and the wiring terminal, reduce the wiring distance and saving materials and a space, such that the whole structure is compact and ordered and high in reliability. For example, the depth of each surge mounting hole ranges from 1.2 mm to 1.5 mm.

As shown in FIG. 3 and FIG. 7, a sidewall of each mounting bump 21 of the utility model protrudes to form a hook 211 which is in interference fit with the corresponding surge mounting hole 11. The hook 211 is of a barb structure. During assembling, the mounting bumps 21 on the surge suppressor 2 are plugged into the surge mounting holes 11, and the hooks 211 extend to the surge mounting holes 11 along with the mounting bumps 21 to naturally buckle the sidewalls of the surge mounting holes 11, such that the surge suppressor 2 is fixedly connected with the base 1. The whole assembly structure is simple, reliable and efficient, and the assembly is convenient without the need for a tool. In an embodiment in which each surge mounting hole 11 cooperates with the corresponding hook 211 of the utility model, the surge mounting hole 11 is a through hole, and the hook 211 is provided at the head of the mounting bump 21; during assembling, the mounting bump 21 of the surge suppressor 2 is plugged into the surge mounting hole 11, and the hook 211 buckles the end part of the sidewall of the surge mounting hole 11 to realize interference connection with the surge mounting hole 11. Therefore, the assembly and disassembly are convenient, and the assembly efficiency is improved. In another embodiment in which each surge mounting hole 11 cooperates with the hook 211 of the utility model, the surge mounting hole 11 is a blind hole; during assembling, the mounting bump 21 of the surge suppressor 2 is plugged into the surge mounting hole 11, and the hook 211 clamps the sidewall of the surge mounting hole 11 to realize interference connection with the surge mounting hole 11. Therefore, the mounting reliability and the mounting stability are improved, without interfering the internal structure of the base. Preferably, each surge mounting hole 11 is a square hole, and at least two surge mounting holes 11 are provided. Correspondingly, each mounting bump 21 is in the shape of a square column, and the number of the mounting bumps 21 is equal to the number of the surge mounting holes 11. The number of the surge mounting holes 11 and the number of the mounting bumps are preferably two, respectively, and the two surge mounting holes 11 and the two mounting bumps 21 are distributed linearly, respectively. Therefore, the mounting firmness is guaranteed, it is also convenient to mount, and accordingly, the mounting efficiency is improved.

Figure 8:
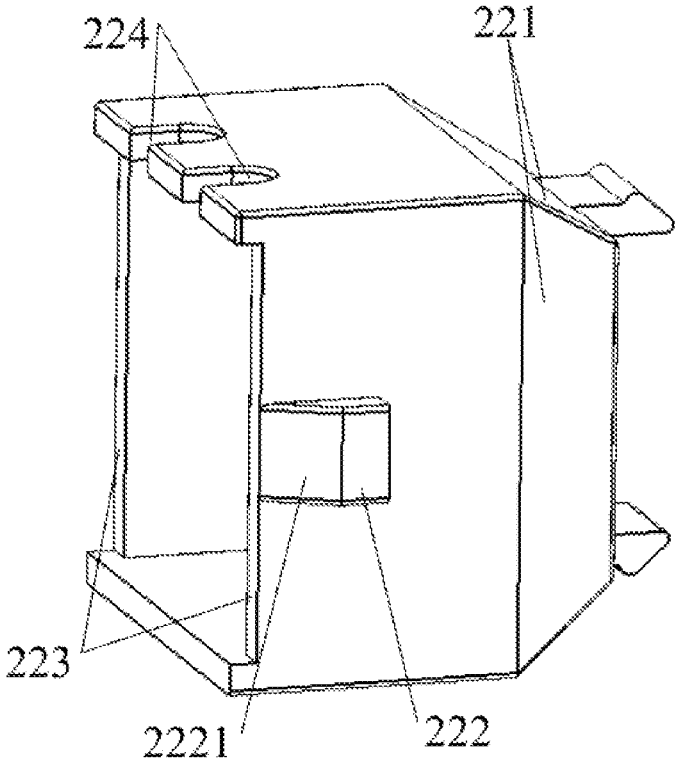
FIG. 8 is a schematic structural diagram of a housing of the surge suppressor of the utility model.
Figure 9:
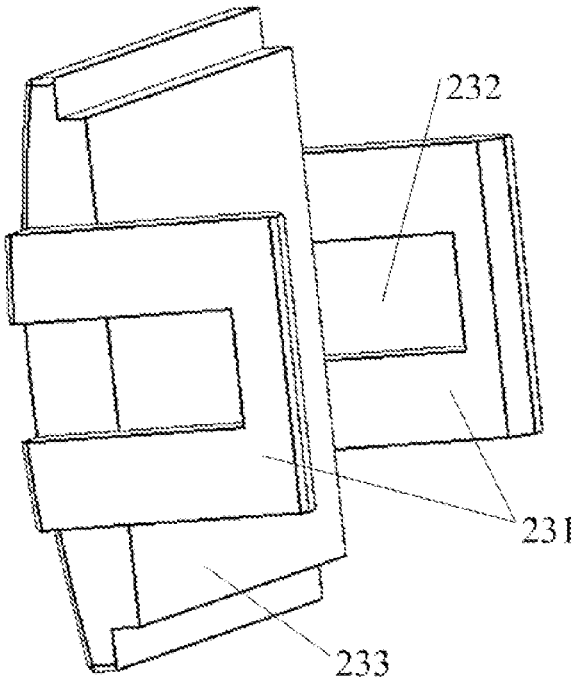
FIG. 9 is a schematic structural diagram of a cover body of the surge suppressor of the utility model.

As shown in FIGS. 7 to 9, the surge suppressor 2 of the utility model comprises a housing 22 with an opening. An open end and a closed end of the housing 22 are oppositely provided left and right, wherein the open end of the housing 22 is covered and fixed with a matched cover body 23 to form a closed space in which internal elements of the surge suppressor 2 are mounted. The mounting bumps 21 are provided on the end surface of the closed end of the housing 22. The surge suppressor 2 is fixedly clamped onto the base 1 through the mounting bumps 21. The end surface of the closed end of the housing 22 of the surge suppressor 2 props against the sidewall of the base 1. Fixing bumps 222 for fixing the cover body 23 are provided at two sides of the housing 22 close to the open end. A fixing lug 231 which is of a U-shaped structure is provided at each of two sides of the cover body 23. An open end of each fixing lug 231 which is of the U-shaped structure is connected to the cover body 23 to form an enclosed fixing hole 232 which cooperates with the corresponding fixing bump 222. During assembling, the fixing bumps 222 of the housing 22 are clamped into the fixing holes 232 of the cover body 23, and the fixing lugs 231 at two sides of the cover body 23 clamp two sidewalls of the housing 22, such that the housing 22 is fixedly connected with the cover body 23. Specifically, each fixing bump 222 is provided with a transition slope 2221 to facilitate assembly. Each transition slope 2221 is inclined along a mounting direction of the cover body 23 towards a direction away from the sidewall of the housing 22. A limiting groove 223 for limiting the cover body 23 is formed in each of two sides of the open end of the housing 22. Limiting bosses 233 which cooperate with the limiting grooves 223 are provided on corresponding positions of the cover body 23, such that the cover body 23 cooperatively covers a port of the housing 22. The closed end of the housing 22 is provided with four trapezoidal lateral slopes 221 which are connected in a surrounding manner. The four lateral slopes 221 are connected in a closing manner through the end surface of the closed end of the housing 22. The end surface of a root of each mounting bump 21 comprises a first connecting surface 212 and a second connecting surface 213 which are angularly provided, wherein the first connecting surface 212 is fitly connected to the end surface of the closed end of the housing 22, and the second connecting surface 213 is fitly connected to the corresponding lateral slope 221 of the housing 22. The upper end surface of the housing 22 is provided with a wiring through hole 224 for wiring of the internal elements of the surge suppressor 2. Specifically, the wiring through hole 224 is provided along the edge of the open end of the housing 22. The enclosed wiring through hole 224 is formed by covering and fixing the open end of the housing 22 with the cover body 23.

FIGS. 1, 4 and 5 illustrate a bulge structure of the coil frame of the utility model. The magnetic yoke 4 is mounted in the base 1. The magnetic yoke support 41 for supporting and buffering the magnetic yoke 4 is provided at each of two sides of the magnetic yoke 4. The coil frame 3 is mounted on the magnetic yoke 4 and sunken into the base 1. An adjusting bulge 311 for adjusting a compression amount of each magnetic yoke support 41 is provided at a position, which cooperates with the magnetic yoke support 41, on the end surface of the lower connecting plate 31 of the coil frame 3. The overall height of the contactor can be finely adjusted by means of the cooperation of the adjusting bulges and the magnetic yoke supports, such that the compression amount of the magnetic yoke supports is improved and the restriction from the interference of the base structure to the coil frame is avoided. In this case, each magnetic yoke support also has a height adjustment allowance, such that the case where the integral assembly cannot be accomplished owing to the dimensional deviation caused in the machining and production process is avoided. The structure is simple, the assembly is convenient, and the product reliability is improved.

As shown in FIG. 5, each adjusting bulge 311 of the utility model is a square bump or a trapezoidal bump. The number of the adjusting bugles 311 may be at least one. The adjusting bulge 311 is preferably a trapezoidal bump, which not only avoids the interference of the base structure and guarantees the assembly of the coil frame, but also improves the stability of the coil frame. The number of the adjusting bulges 311 may be preferably two. Specifically, supporting bosses 312 are provided at four corners of the lower end surface of the coil frame 3. The supporting bosses 312 are of fan-shaped boss structures which are provided along the edges of four corners of the lower connecting plate 31 of the wiring frame 3, wherein two adjusting bulges 311 are respectively provided between every two transverse supporting bosses 312, and are higher than the supporting bosses 312. A groove which is matched with the width of the magnetic yoke 4 is formed between every two longitudinal supporting bosses 312 to avoid the mutual interference with the magnetic yoke 4 during assembling. After assembling, the adjusting bulges 311 of the coil frame 3 are in contact connection with the magnetic yoke supports 41 fixed in the base 1.

FIG. 1 and FIG. 6 illustrate an eccentric structure of the magnetic yoke supports of the utility model. The magnetic yoke 4 is mounted on the bottom plate of the base 1. Each magnetic yoke support 41 for supporting and buffering the magnetic yoke 4 is provided at each of two sides of the magnetic yoke 4, wherein the magnetic yoke support 14 is mounted on the bottom plate of the base 1. The sidewalls at two sides of the magnetic yoke support 14, which are connected with the magnetic yoke 4, are different in thickness. In the present embodiment, a mounting groove 412 is formed in the junction between each magnetic yoke support 41 and the magnetic yoke 4, and the sidewalls at two sides of the mounting groove 512 are different in thickness. The sidewalls at two sides, which are different in thickness, refer to the sidewall of each magnetic yoke support 41, which is in contact connection with the adjusting bulge 311 of the coil frame 3, and the sidewall of the magnetic yoke support 41, which is in contact connection with the bottom plate of the base 1. The different thicknesses refer that, after assembling, the thickness of the sidewall of the magnetic yoke support 41, which is in contact connection with the coil frame 3 is larger than the thickness of the sidewall of the magnetic yoke support 41, which is in contact connection with the bottom plate of the base 1; or, the thickness of the sidewall of the magnetic yoke support 41, which is in contact connection with the coil frame 3 is smaller than the thickness of the sidewall of the magnetic yoke support 41, which is in contact connection with the bottom plate of the base 1. The two cases may be selected by an operator according to actual conditions, such that the total stroke of the product may be adjusted. Since each magnetic yoke support has a simple structure due to the arrangement of the asymmetric eccentric structure. The up-down position of the magnetic yoke relative to the bottom plate of the base may be adjusted by changing the assembling direction of the magnetic yoke support, e.g., a thin wall being above a thick wall or the thick wall being above the thin wall, and therefore, the purpose of adjusting the total stroke of the product may be achieved, and the flexibility is high. When a dimension of a housing of a plastic part is abnormal, the magnetic yoke has a certain adjustment amount to ensure that the integral assembly of the product can be completed and the efficiency and reliability can be improved. A ratio of the thicknesses of the sidewalls at two sides of each magnetic yoke support 41, which are different in thickness, is 4:3. The adjustment effect is more obvious by means of an appropriate adjustment amount.

As shown in FIG. 6, each magnetic yoke support 41 of the utility model is provided with identifying members 411 used for distinguishing the sidewalls at two sides, which are different in thickness. The identifying members 411 may be provided on a thick sidewall of the two sidewalls of the magnetic yoke support 41, which are different in thickness or a thin sidewall of the two sidewalls of the magnetic yoke support 41, which are different in thickness, so as to achieve a distinguishing purpose. Therefore, it is convenient to guarantee that the up-down positions of the thick wall and the thin wall of the magnetic yoke support at each of two sides of the magnetic yoke are consistent during assembling, and it is also convenient to distinguish and adjust at the time of adjustment, such that the efficiency and the reliability are improved. Further, each identifying member 411 is a bulge or a groove and in a circular shape. The position, shape and size of each identifying member 411 are used to distinguish, without interfering the assembly of the magnetic yoke supports 41 and the magnetic yoke 4 or the base 1.

The above content is a further detailed description of the present utility model in combination with specific preferred embodiments, and it cannot be affirmed that the specific implementation of the present utility model is limited to these descriptions. For an ordinary person skilled in the art to which the present utility model belongs, it is also possible to make a number of simple deductions or substitutions without departing from the concept of the present utility model, and these deductions and substitutions all should be regarded to fall within the protection scope of the present utility model.

The invention claimed is:

1. An alternating current contactor, comprising a base and a magnetic yoke, wherein the magnetic yoke is mounted on a bottom plate of the base, and a magnetic yoke support for supporting and buffering the magnetic yoke is respectively provided at two sides of the magnetic yoke, wherein the sidewalls at two sides of each magnetic yoke support, which are connected with the magnetic yoke are different in thickness.

2. The alternating current contactor according to claim 1, wherein each magnetic yoke support is provided with identifying members used for distinguishing the sidewalls at two sides, which are different in thickness.

3. The alternating current contactor according to claim 2, wherein each identifying member is a bulge or a groove.

4. The alternating current contactor according to claim 2, wherein each identifying member is circular.

5. The alternating current contactor according to claim 1, wherein a ratio of the thicknesses of the sidewalls at two sides of each magnetic yoke support, which are different in thickness, is 4:3.

6. The alternating current contactor according to claim 1, wherein a mounting groove is provided at a junction between each magnetic yoke support and the magnetic yoke, and sidewalls at two sides of the mounting groove are different in thickness.

7. The alternating current contactor according to claim 6, wherein the bottom of the magnetic yoke is provided with a magnetic yoke through hole that is penetrated horizontally, a magnetic yoke mounting sheet penetrates through the magnetic yoke through hole, and two ends of the magnetic yoke mounting sheet that are exposed out of the magnetic yoke are wrapped and fixed with the magnetic yoke supports for supporting and buffering the magnetic yoke.

8. The alternating current contactor according to claim 7, wherein the magnetic yoke is fixedly connected with the base through the magnetic yoke supports at two sides, two horizontally inverted concave platforms are oppositely provided between two sidewalls in the base, and a recessed sidewall of each concave platform is provided with a fixing groove for fixing the corresponding magnetic yoke support; the mounting groove which cooperates with the corresponding magnetic yoke mounting sheet is formed in one end of the square blocky block shaped magnetic yoke support, and a fixing bump which cooperates with the fixing groove and in the shape of a triangular prism is provided at the other end of the magnetic yoke support; a magnetic yoke mounting groove in which the magnetic yoke and a part of the magnetic yoke mounting sheet, which is wrapped with the magnetic yoke support are mounted, is formed between the concave platform and the base; during mounting, the magnetic yoke is mounted into the magnetic yoke mounting groove, and the part of each magnetic yoke mounting sheet, which is wrapped with the magnetic yoke support is clamped into the recessed part of each of the two concave platforms, and meanwhile, the fixing bump is clamped into the fixing groove to fix the magnetic yoke.

9. The alternating current contactor according to claim 1, wherein a buffering cushion for buffering the magnetic yoke is provided between the base and the magnetic yoke.

10. The alternating current contactor according to claim 1, wherein a coil frame mounted on the magnetic yoke is provided inside the base and comprises an upper connecting plate and a lower connecting plate and a wiring post provided between the upper connecting plate and the lower connecting plate; an annular groove in which a coil is placed is formed among the upper connecting plate, the lower connecting plate and the wiring post; the wiring post is axially provided with a frame through hole, and the coil frame is fixed on the magnetic yoke through the frame through hole formed in the wiring post; the magnetic yoke is of an E-type structure, wherein the E-type magnetic yoke is mounted on the bottom plate of the base, with an opening facing upwards; the coil frame slides to an adjusting bulge of the coil frame along the middle part of the E-type magnetic yoke and props against the corresponding magnetic yoke support of the magnetic yoke; a wiring terminal which is connected with the coil is mounted on a sidewall of the base, the outer wall at one side of the base, which is close to the wiring terminal is provided with two surge mounting holes which are used for fixing a surge suppressor and distributed linearly; the outer wall of the surge suppressor, which contacts the base is correspondingly provided with two mounting bumps which cooperate with the surge mounting holes, and a sidewall of each mounting bump protrudes to form a hook which is in interference fit with the corresponding surge mounting hole; the surge suppressor is plugged into the surge mounting holes of the base through the mounting bumps on the surge suppressor to be fixedly connected with the base; after assembling, the surge suppressor is adjacent to the wiring terminal to facilitate a wiring connection therebetween.

* * * * *